US005740963A

United States Patent [19]

Riney et al.

[11] Patent Number: 5,740,963

[45] Date of Patent: Apr. 21, 1998

[54] SELF-SEALING SLOT NOZZLE DIE

[75] Inventors: John M. Riney, Suwanee; Roger A. Ziecker, Lawrenceville; Alan R. Ramspeck, Cumming, all of Ga.

[73] Assignee: Nordson Corporation, Westlake, Ohio

[21] Appl. No.: 779,790

[22] Filed: Jan. 7, 1997

[51] Int. Cl.[6] ..... B05B 7/16

[52] U.S. Cl. ..... 239/299; 239/433; 239/553; 239/562; 239/597; 239/600

[58] Field of Search ..... 239/290, 296, 239/299, 600, 418, 597, 568, 583, 562, 553, 590, 433

[56] References Cited

U.S. PATENT DOCUMENTS

| | | | |
|---|---|---|---|
| 4,785,996 | 11/1988 | Ziecker et al. | 239/600 X |
| 5,145,689 | 9/1992 | Allen et al. . | |
| 5,169,071 | 12/1992 | Boger et al. | 239/600 X |
| 5,236,641 | 8/1993 | Allen et al. . | |
| 5,269,670 | 12/1993 | Allen et al. . | |
| 5,354,378 | 10/1994 | Hauser et al. . | |
| 5,389,151 | 2/1995 | Fort | 239/600 X |
| 5,409,733 | 4/1995 | Boger et al. . | |
| 5,418,009 | 5/1995 | Raterman et al. . | |
| 5,421,921 | 6/1995 | Gill et al. . | |
| 5,421,941 | 6/1995 | Allen et al. . | |
| 5,423,935 | 6/1995 | Benecke et al. . | |
| 5,429,840 | 7/1995 | Raterman et al. . | |
| 5,445,509 | 8/1995 | Allen et al. . | |
| 5,458,291 | 10/1995 | Brusko et al. . | |
| 5,524,828 | 6/1996 | Raterman et al. . | |
| 5,533,675 | 7/1996 | Benecke et al. . | |
| 5,622,315 | 4/1997 | Keane et al. | 239/600 X |

FOREIGN PATENT DOCUMENTS

| | | | |
|---|---|---|---|
| 1204951 | 1/1960 | France | 239/600 |

*Primary Examiner*—Kevin Weldon

*Attorney, Agent, or Firm*—Wood, Herron & Evans, L.L.P.

[57] ABSTRACT

A slot nozzle die for use with a coating dispenser includes a first die body having a tapered projection and a deflectable tab member horizontally spaced from the tapered projection to define a die seat therebetween. A second die body having a tapered projection is slidably received in the die seat formed in the first die body. The tapered projections of the first and second die bodies define an extrusion slot therebetween which receives coating material from the coating dispenser. A pair of air blocks are respectively mounted to lower ends of each die body to define a pair of air channels disposed at an angle relative to the extrusion slot. One of the air blocks is slidably received intermediate the deflectable tab member and the tapered projection of the second die body and cooperates with the deflectable tab member for translating the tapered projection of the second die body toward the tapered projection of the first die body to seal the first and second die bodies.

20 Claims, 5 Drawing Sheets

SELF-SEALING SLOT NOZZLE DIE

FIELD OF THE INVENTION

The present invention relates generally to non-contact coating apparatus for applying full and fibrous coatings to substrates and, more particularly, to a slot nozzle die for use with a coating dispenser in the application of discrete, uniform full and fibrous coatings having sharp, square cut-on and cut-off edges.

BACKGROUND OF THE INVENTION

Non-contact coating dispensers for applying adhesives, paint and other viscous materials to a substrate in defined patterns are well known in the art. Typically, these dispensers apply coating materials as parallel lines or bands of varying widths, as swirls, or as uniform fibrous webs. The pattern of the coating material applied to a substrate is determined by the physical structure of the die attached to or integral with the coating dispenser.

Thus, coating dispensers for applying continuous beads or strands of hot melt adhesive, for example, have generally incorporated multiple orifice dies which dispense adhesive in parallel lines which are generally defined by the spacing between the orifices in the die head and the size of each die orifice. The multiple orifice dispenser may include intermittent control of adhesive discharge through each die orifice for forming discrete strand patterns of adhesive. An example of such an adhesive dispenser for use in the manufacture of diapers and incontinence pads is disclosed in U.S. Pat. No. 4,874,451 assigned to Nordson Corporation of Amherst, Ohio, assignee of the present invention.

Coating dispensers for applying continuous bands or sheets of hot melt adhesive to a substrate typically incorporate a slot nozzle die mounted to the dispenser body. Adhesive material is supplied from an adhesive cavity to an extrusion slot formed between two juxtaposed die halves, and the extrusion slot terminates in an elongated slot nozzle. As with the multiple orifice adhesive dispensers, slot nozzle die dispensers may also include intermittent control of adhesive flow to the elongated slot nozzle to provide discrete adhesive sheet or band patterns.

In yet another type of coating dispenser, one or more continuous beads of adhesive are emitted from a multiple orifice die, with multiple air jets disposed around each orifice. The multiple air jets drive air tangentially relative to the orientation of the adhesive bead as it emits from the die orifice, thereby attenuating each adhesive bead and causing the beads to swirl before being deposited on a substrate. Examples of swirl pattern coating dispensers are disclosed in U.S. Pat. Nos. 4,785,996, 4,815,660 and 5,292,068, all owned by Nordson Corporation, assignee of the present invention.

For applications requiring the deposition of uniform fibrous webs of hot melt adhesive on a substrate, coating dispensers have incorporated slot nozzle dies with one or more air channels disposed at an angle relative to the elongated slot nozzle of the die. As the hot melt adhesive emits from the slot nozzle as a continuous sheet or curtain, pressurized air from the air channels disposed on either side of the slot nozzle attenuate and fiberize the curtain of adhesive to form a uniform fibrous web of adhesive on a substrate. Recently, fibrous web coating dispensers have incorporated intermittent control of adhesive and air flow to form discrete, uniform fibrous coatings having sharp, square cut-on and cut-off edges. For example, U.S. Pat. Nos. 5,418,009, 5,421,921, 5,423,935 and 5,533,675, all owned by the assignee of the present invention, disclose a slot nozzle die comprising a pair of die bodies forming an extrusion slot therebetween and a pair of air blocks attached to lower ends of the die bodies for forming a pair of air channels disposed at an angle relative to the extrusion slot. These slot nozzle adhesive dispensers include valving systems for controlling the intermittent flow of adhesive and air through the die structure and air channels.

With each of the different types of die structures, i.e., bead, slot, swirl and curtain fiberization dies, it has generally been required in the past to dedicate a specific dispenser body construction to only one or a few of the different die structures. That is, for a given dispenser body construction, only one or a few of the different types of die structures has been interchangeable on the dispenser body. Thus, a dispenser or applicator line which incorporates multiple dispenser bodies and multiple die heads in a row, for example, becomes dedicated to applying only one or a few different adhesive patterns as determined by the different interchangeable die heads which are adapted for use with the dispenser body.

Moreover, for dispensers which incorporate slot nozzle dies having air channels disposed at an angle relative to an extrusion slot within the die, it has generally been necessary to attach the slot nozzle die body to a dispenser body with multiple fasteners extending in more than plane to provide adequate sealing of the adhesive extrusion slot and air channels within the die. Thus, several vertically disposed fasteners are typically provided to attach the slot nozzle die body to a lower end of the dispenser body, while other fasteners, typically disposed transversely to the vertically disposed screws, are provided to attach the air blocks to a lower end of the die body. The transverse screws further provide the necessary pneumatic sealing between the air blocks and die body, and hydraulic sealing between mating die surfaces. The requirement for multiple fasteners in multiple planes to attach the die body and air blocks to the dispenser body, and to provide necessary pneumatic and hydraulic seals within the die, has thus limited the interchangeabilty of the fiberization die with other types of die structures.

Accordingly, it is a primary objective of the present invention to provide a slot nozzle or fiberization die which is fully interchangeable with other types of die structures on a specific dispenser body configuration.

A further objective of the present invention is to provide a slot nozzle die structure which is fastened to a dispenser body in only one direction, while providing the necessary tight hydraulic and pneumatic seals of the extrusion slot and air channels without additional fasteners.

It is yet another objective of the present invention to provide a slot nozzle die which is modular in construction for easy disassembly to clean adhesive char and other contaminants from within the die body.

SUMMARY OF THE INVENTION

To these ends, a slot nozzle or fiberization die for use with a coating dispenser is provided which is fully interchangeable with bead, slot or swirl die bodies mounted on a specific dispenser body. The slot nozzle die attaches to a lower end of the dispenser body in a substantially vertical direction through a set of vertically disposed screws, without additional transverse screws or fasteners for sealing internal adhesive and air flow paths within the die. The slot nozzle die of the present invention includes various die components which are mounted in an interfitting arrangement on the dispenser body, and which are adapted to seal the adhesive and air flow paths within the die structure through cooperation of the parts and without additional fasteners. The die is modular in construction to permit the die to be readily disassembled for cleaning of internal surfaces and flow paths within the slot nozzle die.

The slot nozzle die of the present invention is adapted for use with a coating dispenser having a coating material supply passage and a plunger movable within the supply passage. The slot nozzle die includes a first die body having a tapered projection defined by a substantially vertical inward surface and a tapered outer wall. The first die body further preferably includes a deflectable tab member depending therefrom and horizontally spaced from the tapered projection to define a die seat between the tapered projection and the deflectable tab member.

A second die body having a tapered projection defined by a substantially vertical inward surface and a tapered outer wall is adapted to be slidably received in the die seat formed in the first die body. The substantially vertical inward surfaces of the tapered projections define an extrusion slot therebetween which receives coating material from the supply passage of the coating dispenser for application by the slot nozzle die.

A pair of air blocks are respectively mounted to lower ends of each die body. Each air block includes a tapered inward surface juxtaposed in operative disposition near one of the tapered outer walls of the tapered projections to form an air channel between each of the air blocks and the tapered projections. In accordance with the present invention, one of the air blocks is slidably received intermediate the deflectable tab member and the tapered projection of the second die body. In one embodiment, the air block includes a tapered outer surface which cooperates with a substantially vertical inward surface of the deflectable tab member for translating the tapered projection of the second die body toward the tapered projection of the first die body. In this way, the extrusion slot formed between the tapered projections, and the air channels formed between the air blocks and the tapered projections, are sealed without the requirement of additional transverse fasteners for this purpose. Additionally, in one embodiment, the die bodies and air blocks include seating surfaces which cooperate to improve the sealing of the extrusion slot and the air channels. In another embodiment, the die bodies and air blocks include protrusions which function to pivot the parts for providing necessary pneumatic and hydraulic sealing of the air channels and extrusion slot.

In one embodiment, the die bodies and the air blocks include air passages which communicate with a selectively operable air source connected to the dispenser body. The air passages in the die bodies and air channels provide a flow path for pressurized air to communicate with the air channels disposed on either side of the extrusion slot. In operation, as coating material emits from the extrusion slot as a curtain, the pressurized air from the air channels impinges upon, attenuates, and fiberizes the curtain of material to form a fibrous web of coating material on a substrate. Alternatively, the die bodies may be used to apply a full coat or wide solid ribbon pattern of coating material on a substrate. With intermittent control of the adhesive and air flow, the slot nozzle die provides discrete, uniform full and fibrous coatings having sharp, square cut-on and cut-off edges.

The above and other objects and advantages of the present invention shall be made apparent from the accompanying drawings and the description thereof.

BRIEF DESCRIPTION OF THE DRAWING

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

Figure 1:
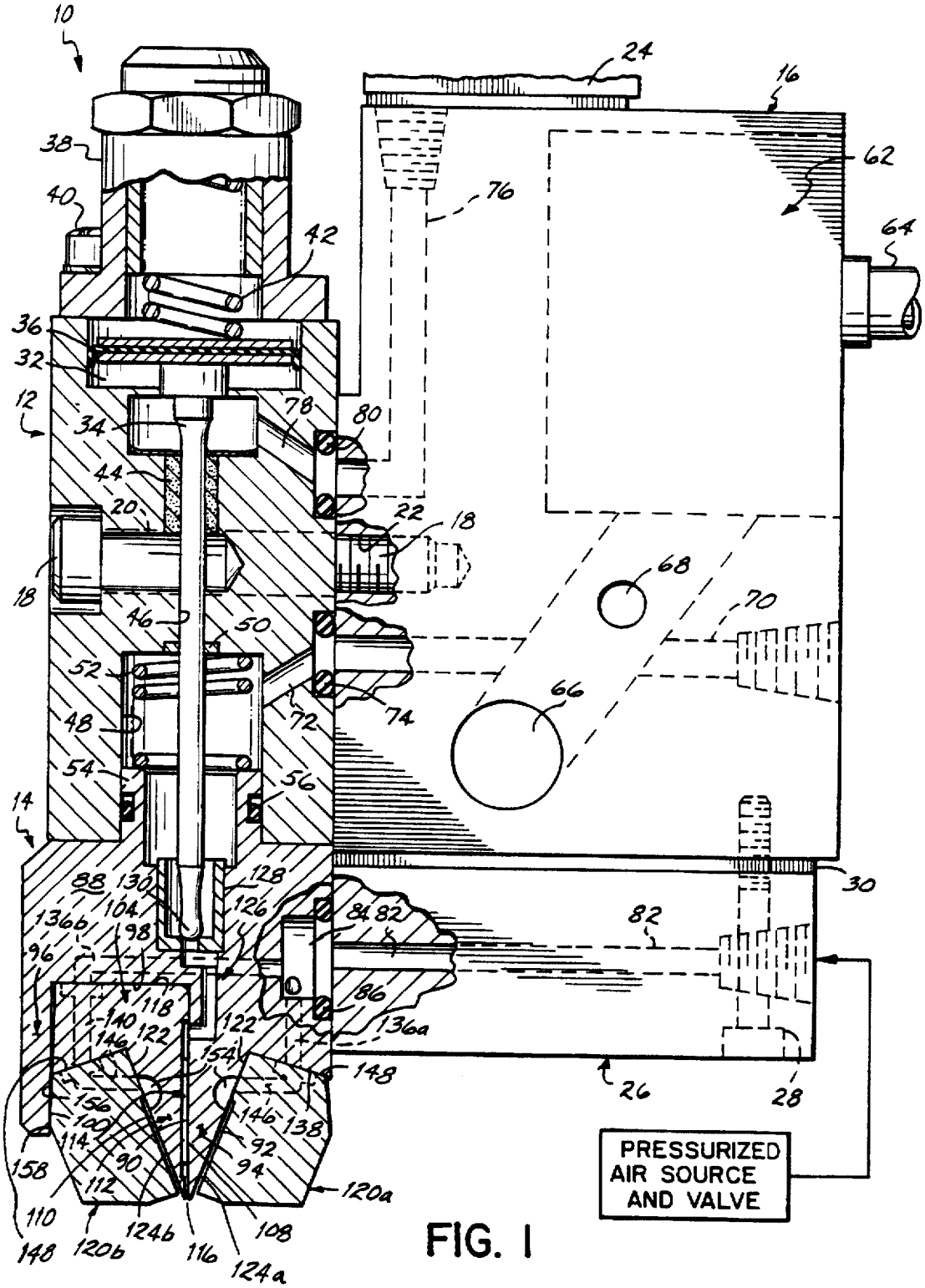
FIG. 1 is a diagrammatic side view, in partial cross-section, illustrating a self-sealing slot nozzle die in accordance with the present invention mounted on a lower end of a coating dispenser.

Referring now to the figures, and to FIG. 1 in particular, a coating dispenser 10 is illustrated comprising a dispenser body 12 having the self-sealing slot nozzle die 14 of the present invention connected at a lower end. As used herein, the term "coating" or "coating material" applies to, but is in no way limited to, cold glues, hot melt adhesives, paints, or other materials of either an adhesive or non-adhesive nature. For purposes of simplifying description of the present invention, the preferred embodiment will hereinafter be described in relation to the dispensing of hot melt adhesives, but those skilled in the art will readily appreciate application of the present invention to the dispensing of other coating materials as well.

The dispenser body 12 is mounted to an adhesive manifold 16 via a pair of screws 18 (only one shown) which extend through transverse bores 20 in the dispenser body and thread into threaded bores 22 in the adhesive manifold. In turn, the adhesive manifold 16 is supported on a bar (not shown) by a mounting block 24 connected to the adhesive manifold with screws (not shown). The adhesive manifold 16 carries an air manifold 26 via two or more screws 28 (only one shown), each of which extends through a spacer 30 mounted between the adhesive and air manifolds 16 and 26, respectively. The structure of dispenser body 12 is substantially identical to the Model H200 spray gun manufactured and sold by the assignee of this invention, Nordson Corporation of Amherst, Ohio. This structure forms no part of this invention per se, and is, therefore, discussed briefly for purposes of background only.

As shown in FIG. 1, the upper portion of dispenser body 12 is formed with an air cavity 32 which receives the upper end of a valve plunger 34 having a seal 36 mounted at its upper end. The seal 36 is axially slidable within the air cavity 32 and provides an air tight seal with walls of the air cavity. A cap 38 is mounted to an upper end of the dispenser body 12 via a pair of screws 40 which thread into a pair of threaded bores formed in the upper end of the dispenser body (not shown). The cap 38 includes a spring 42 for limiting upper travel of the valve plunger 34 within the air cavity 32 and returning the plunger to a closed position after a coating operation.

The valve plunger 34 is sealed at the base of the air cavity 32 by a seal 44 which permits axial movement of the plunger through the seal. Valve plunger 34 extends axially downwardly from the air cavity 32 through an axial bore 46 in the dispenser body 12 which leads to an adhesive cavity or supply passage 48 having a seal 50 at its upper end. The seal 44, axial bore 46, and seal 50 aid in guiding axial movement of valve plunger 34 within the dispenser body 12.

An axially compressible spring 52 is located within the adhesive cavity 48 and extends between the upper end of the adhesive cavity and a mounting end 54 of the slot nozzle die 14. The mounting end 54 of slot nozzle die 14 extends into a lower end of the adhesive cavity 48 and is sealed with walls of the adhesive cavity via an O-ring 56. As will be described in greater detail below, the slot nozzle die 14 is mounted to the lower end of the dispenser body 12 via four screws 58 (see FIGS. 2–4) which extend through unthreaded bores 60 (see FIG. 2) in the slot nozzle die and are connected to threaded bores (not shown) formed in the lower end of the dispenser body.

With further reference to FIG. 1, the adhesive manifold 16 is formed with a junction box 62 which receives an electric cable 64 to supply power to a heater 66 and a resistive thermal device 68. Heater 66 maintains the hot melt adhesive in a molten state when it is introduced into the adhesive manifold 16 through an adhesive inlet line 70 connected to a source of hot melt adhesive (not shown). The dispenser body 12 is heated by conduction via its contact with adhesive manifold 16, and the slot nozzle die 14 conducts heat by its contact with the dispenser body 12.

The adhesive inlet line 70 in adhesive manifold 16 communicates with the adhesive cavity 48 through a connector line 72 formed in the dispenser body 12. An O-ring 74 is provided between the dispenser body 12 and the adhesive manifold 16 at the junction of the adhesive inlet line 70 and connector line 72 to form a seal therebetween. Operating air for the valve plunger 34 is supplied through an air inlet line 76 formed in the adhesive manifold 16 which is joined by a connector line 78 to the air cavity 32. At the junction of the air inlet line 76 and the connector line 78, an O-ring 80 is provided between the dispenser body 12 and the adhesive manifold 16 to form a seal therebetween.

The air manifold 26 is formed with an air inlet line 82 connected to a stepped air connector bore 84 formed in the slot nozzle die 14. Preferably, a selectively operable air source is connected to the air inlet line 82 for providing controlled intermittent air supply to the air connector bore 84. An O-ring 86 forms a fluid-tight seal between the slot nozzle die 14 and the air manifold 26 at the junction of the air inlet line 82 and air connector bore 84.

Figure 2:
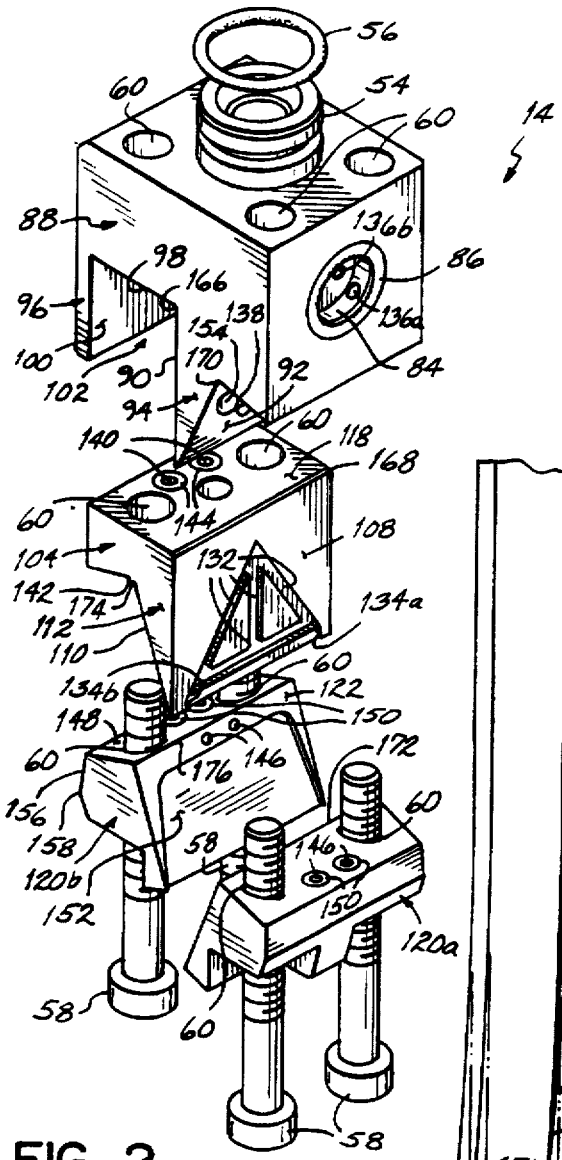
FIG. 2 is an exploded view of the slot nozzle die of FIG. 1.
Figure 3:
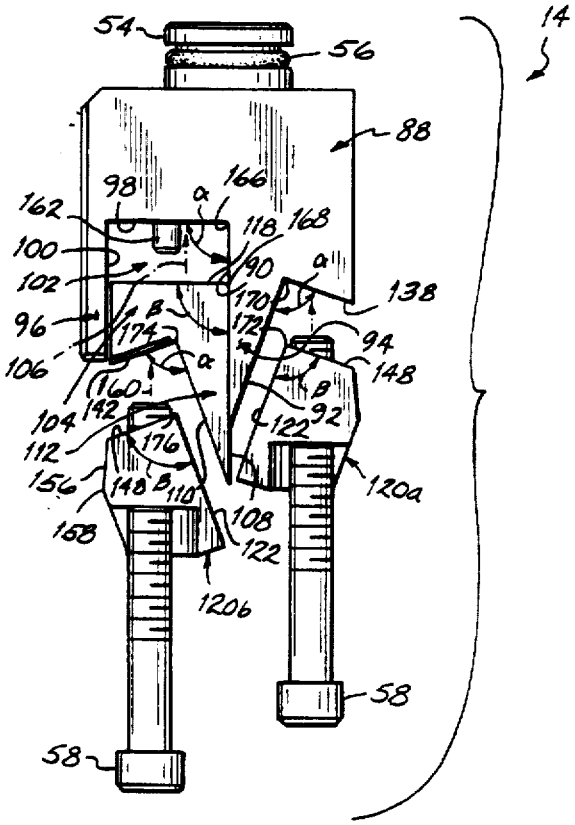
FIG. 3 is a diagrammatic side view of the slot nozzle die of FIG. 1 showing the interfitting arrangement of various die components.
Figure 4:
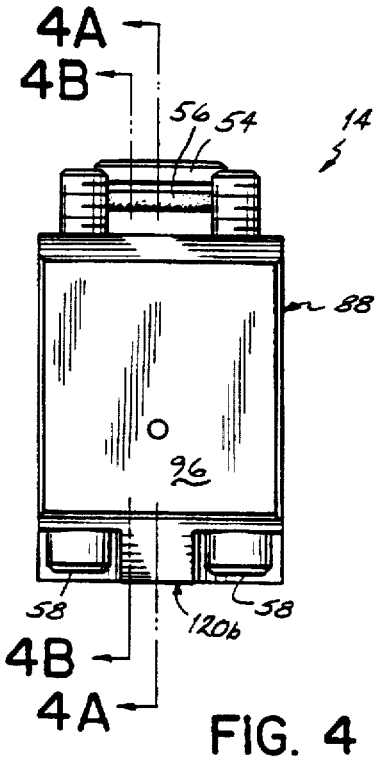
FIG. 4 is a rear view of the slot nozzle die of FIG. 3.

As shown most clearly in FIGS. 1–3, the slot nozzle die 14 includes various interfitting die components which collectively are mounted to the lower end of the dispenser body 12 via the screws 58. In one embodiment of the present invention, the slot nozzle die 14 includes a die body 88 having the mounting end 54 integral with the die body for connection with the adhesive cavity 48. Die body 88 includes a substantially vertical inward surface 90 and a tapered outer surface 92 which converge at a lower end of the die body to form a tapered projection 94.

An integral tab member 96 is horizontally spaced from the substantially vertical inward surface 90 of die body 88 by a seating surface 98 which extends between upper ends of the tab member and the tapered projection 94. Tab member 96 preferably includes a substantially vertical inward surface 100 which, in combination with the seating surface 98 and the substantially vertical inward surface 90, define a die seat 102 for slidably receiving a die body 104 in a substantially vertical direction as shown by arrow 106 in FIG. 3.

Die body 104 includes a substantially vertical inward surface 108 and a tapered outer surface 110 which converge at a lower end of the die body to form a tapered projection 112. The substantially vertical inward surfaces 90 and 108 of die bodies 88 and 104, respectively, define an extrusion slot 114 therebetween which terminates in a coating material outlet, preferably an elongated slot nozzle 116, for applying hot melt adhesive in accordance with the present invention. As will be described in more detail below, a seating surface 118 on an upper end of the die body 104 cooperates with the seating surface 98 of die body 88 to improve sealing of the extrusion slot 114 formed between the tapered projections 94 and 112.

A pair of air blocks 120*a* and 120*b* are mounted on lower ends of the die bodies 88 and 104, respectively. Each air block 120*a* and 120*b* includes a tapered inward surface 122 juxtaposed in operative disposition near one of the tapered outer surfaces 92 and 110 of the die bodies 88 and 104, respectively, to partially define a pair of air channels 124*a* and 124*b* disposed at an angle with respect to the extrusion slot 114.

Figure 4A:
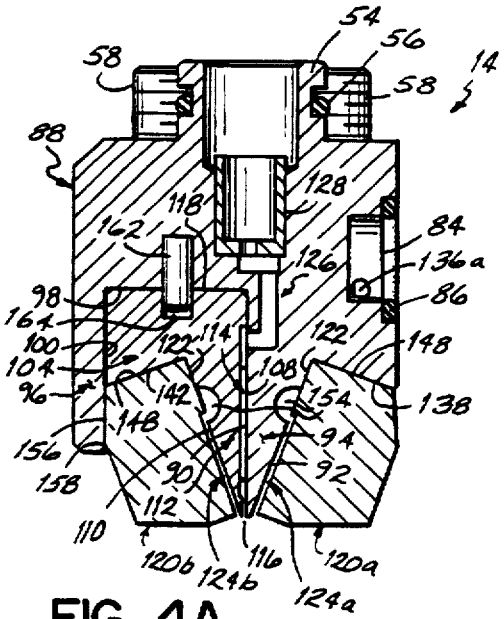
FIG. 4A is a cross-sectional view, taken along line 4A—4A in FIG. 4, showing a coating passage within the slot nozzle die for delivering coating material to an extrusion slot formed within the die.

As shown most clearly in FIGS. 1 and 4A, the die body 88 includes a stepped bore or supply passage 126 for delivering hot melt adhesive from the adhesive cavity 48 to the extrusion slot 114. A valve seat 128, preferably made of carbide, is located in the stepped bore 126 which cooperates with a ball 130 on the lower end of the valve plunger 34 for providing controlled intermittent supply of hot melt adhesive to the extrusion slot 114. In this way, hot melt adhesive may be applied through the elongated slot nozzle 116 in discrete patterns with sharp, square cut-on and cut-off edges.

With reference to FIG. 2, the substantially vertical inward surface 108 of die body 104 preferably includes a series of adhesive distribution channels 132 which are adapted to receive hot melt adhesive from the supply passage 126 and evenly distribute the adhesive throughout the extrusion slot 114 for non-contact application through the elongated slot nozzle 116. The elongated slot nozzle 116 has edges 134*a* and 134*b* (see FIG. 2) which define the edge pattern or edge definition of an adhesive coating as it is applied by the coating dispenser 10. In one embodiment, the edges 134*a* and 134*b* may extend outwardly to provide full adhesive coverage or, in another embodiment, the edges may be substantially vertical for sharp edge cut off. In yet another embodiment, the elongated slot nozzle 116 may extend the entire length of the die body 104 without any edges 134a or 134b to define an edge pattern.

Figure 4B:
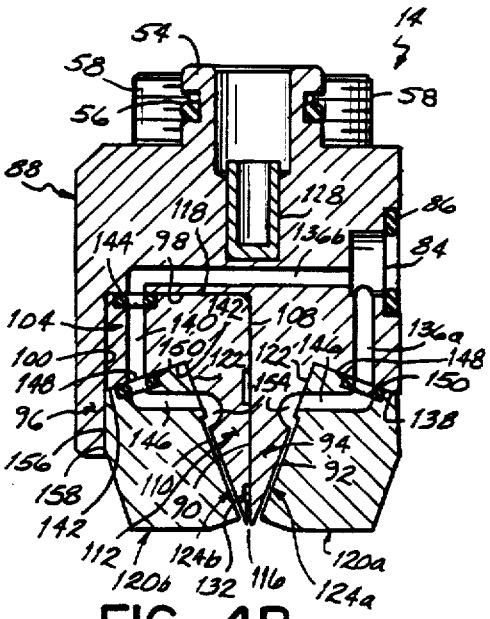
FIG. 4B is a cross-sectional view, taken along line 4B—4B in FIG. 4, showing air passages within the slot nozzle die for delivering air to a pair of air channels disposed at an angle relative to the extrusion slot.

As shown in most clearly in FIGS. 1, 2 and 4B, the die body 88 has a pair of air passages 136a (only one shown) which extend between the air connector bore 84 and a seating surface 138 on a lower end of the die body 88, and a second pair of air passages 136b (only one shown) which extend between the air connector bore and the seating surface 98. A pair of air passages 140 in die body 104 extend between the seating surface 118 and a seating surface 142 on a lower end of the die body 104. A pair of O-rings 144 (only one shown) are provided on the seating surface 118 at the junction of air passages 136b and air passages 140 to form a seal between die body 88 and die body 104.

Each of the air blocks 120a and 120b has a pair of air passages 146 which extend between a seating surface 148 on an upper end of each air block and the tapered inward surfaces 122 of the air blocks. A pair of O-rings 150 are provided on each of the seating surfaces 148 at the junction of the air passages 136a and 140 with air passages 146 to form a seal between the air blocks and respective die bodies 88 and 104.

Preferably, as shown most clearly in FIG. 2, each of the tapered inward surfaces 122 of the air blocks incorporates a groove or slot 152 having a recessed surface which is parallel to surface 122. The tapered outer surfaces 92 and 110 of die bodies 88 and 104, respectively, further preferably include diffusers 154 to direct air within the air channels 124a and 124b. In this way, an air source (not shown) connected to the air inlet line 82 is selectively operable to deliver controlled intermittent air to the air channels 124a and 124b of the slot nozzle die 14 during operation of the coating apparatus 10 as will be described in more detail below.

In accordance with the present invention, the slot nozzle die 14 is adapted to be mounted to a lower end of the dispenser body via the set of screws 58. Screws 58 are advanceable in a substantially vertical direction with respect to the dispenser body 12 and, thus, only provide a vertical clamping force directed toward the dispenser body 12, as represented by force arrow "$F_1$" in FIG. 5. To provide the necessary tight seal between the substantially vertical inward surfaces 90 and 108 of die bodies 88 and 104, respectively, which form the extrusion slot 114, and to seal the air channels 124a and 124b formed between the die bodies and the air blocks 120a and 120b, a substantially horizontal clamping force, as represented by force arrow "$F_2$", is provided by the interfitting arrangement of the various slot nozzle die components as will be described below.

Figure 5:
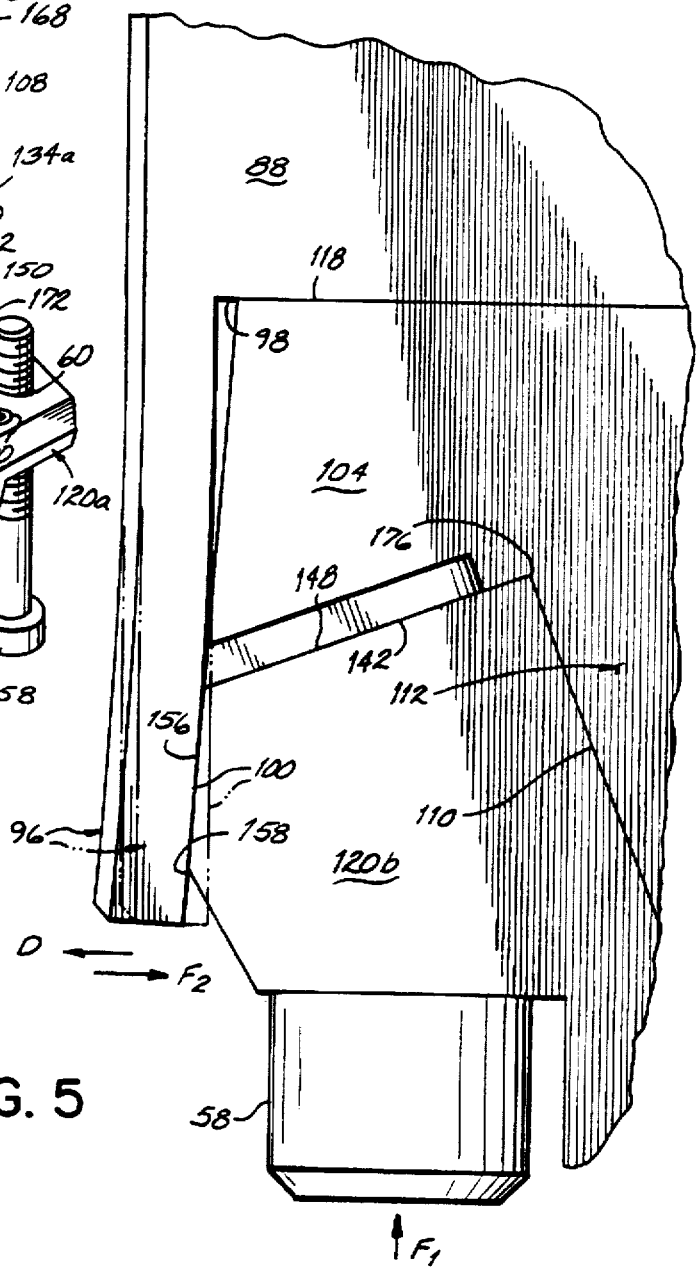
FIG. 5 is an enlarged fragmentary view, partially broken away, showing in greater detail the interfitting arrangement of the various die components shown on the left side of FIG. 3.

In one embodiment of the present invention, as shown most clearly in FIGS. 3 and 5, the air block 120b includes a tapered outer surface 156 which establishes a protrusion 158 on the side of the air block 120b opposite the tapered inward surface 122. During assembly of the slot nozzle die 14, the die body 104 is first slidably received in the die seat 102 in a substantially vertical direction as represented by arrow 106 in FIG. 3. Next, air block 120b is slidably received in the die seat 102 in a substantially vertical direction as represented by arrow 160 in FIG. 3. As shown in the figures, air block 120b is disposed intermediate the tab member 96 and the tapered projection 112.

As the air block 120b is advanced vertically toward the dispenser body 12 through advancement of the screws 58, the protrusion 158 eventually meets with the substantially vertical inward surface 100 of tab member 96 which, in turn, causes a deflection of the tab member in a substantially horizontal direction as represented by directional arrow "D" in FIG. 5. In one embodiment, the deflection of tab member 96 occurs during the last 0.030" travel of the air block 120b vertically toward the dispenser body 12.

The substantially horizontal deflection of tab member 96 causes the resultant clamping force "$F_2$" to translate the air block 120b toward the tapered projection 112, which, in turn, translates toward the tapered projection 94 to seal the extrusion slot 114 formed between the tapered projections. Air channels 124a and 124b are likewise sealed between the air blocks 120a and 120b, and the tapered projections 94 and 112, by the resultant clamping force "$F_2$". The unthreaded bores 60 provide a degree of float with the screws 58 to accommodate for the clamping effect caused by the resultant clamping force "$F_2$" provided by the deflectable tab member 96. Preferably, the air block 120a also includes the tapered outer surface 156 and protrusion 158 such that the air blocks are identical and, therefore, interchangeable.

As shown in FIGS. 3 and 4A, the die body 88 preferably includes a guide pin 162 which extends into the die seat 102. The die body 104 has an elongated bore 164 (see FIGS. 2 and 4A) in the seating surface 118 which receives the guide pin 162 during assembly of the slot nozzle die 14. The guide pin 162 and bore 164 thereby improve registration of the die bodies 88 and 104 during assembly of the slot nozzle die 14.

To simplify manufacturing of the slot nozzle die 14, and to further improve its self-sealing capabilities, the substantially vertical inward surface 90 and seating surface 98 of die body 88 form an inside corner 166 which is machined to 89.5°–90° as represented by angle "α" in FIG. 2. The substantially vertical inward surface 108 and the seating surface 118 of die body 104 form an outside corner 168 which is machined to 90°–90.5° as represented by angle "β" in FIG. 2. In this way, referencing a worst case scenario where the inside corner 166 is machined to 89.5° while the outside corner 168 is machined to 90.5°, the cooperation of the seating surfaces 98 and 118 will result in the tapered projection 112 "pivoting" toward the tapered projection 94, thereby improving the seal of the extrusion slot 114. Thus, the requirement to machine perfect 90° corners on various die parts for sealing purposes is completely eliminated from the manufacturing process.

With further reference to FIGS. 2 and 3, die body 88 has an inside corner 170 which is machined to 89.5°–90° as represented by angle "α", while air block 120a has an outside corner 172 which is machined to 90°–90.5° as represented by angle "β". Thus, seating surfaces 138 and 148 will cooperate to "pivot" the tapered inward surface 122 of air block 120a toward the tapered outer surface 92 of die body 88 to improve sealing of the air channel 124a.

In a similar fashion, die body 104 has an inside corner 174 which is machined to 89.5°–90° as represented by angle "α", while air block 120b has an outside corner 176 which is machined to 90°–90.5° as represented by angle "β". In this way, seating surfaces 142 and 148 will also cooperate to "pivot" the tapered inward surface 122 of air block 120b toward the tapered outer surface 110 of die body 104 to improve sealing of the air channel 124b.

Figure 6:
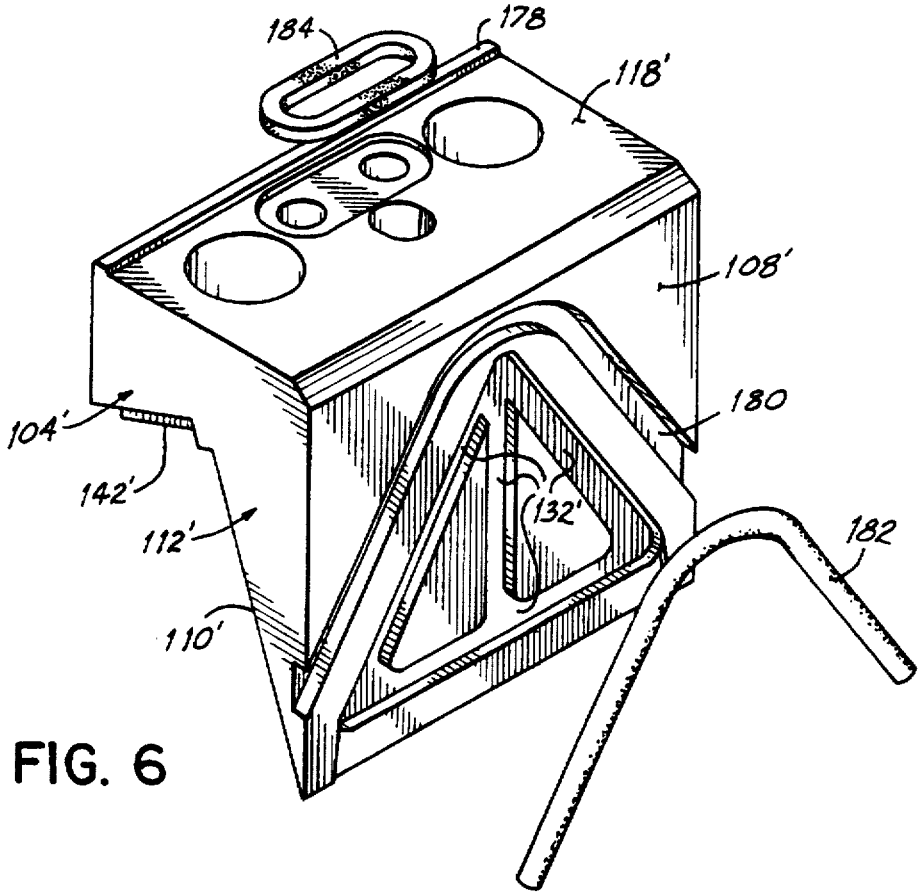
FIG. 6 is an enlarged perspective view of an alternative die body for use in the slot nozzle die of FIG. 1.
Figure 7:
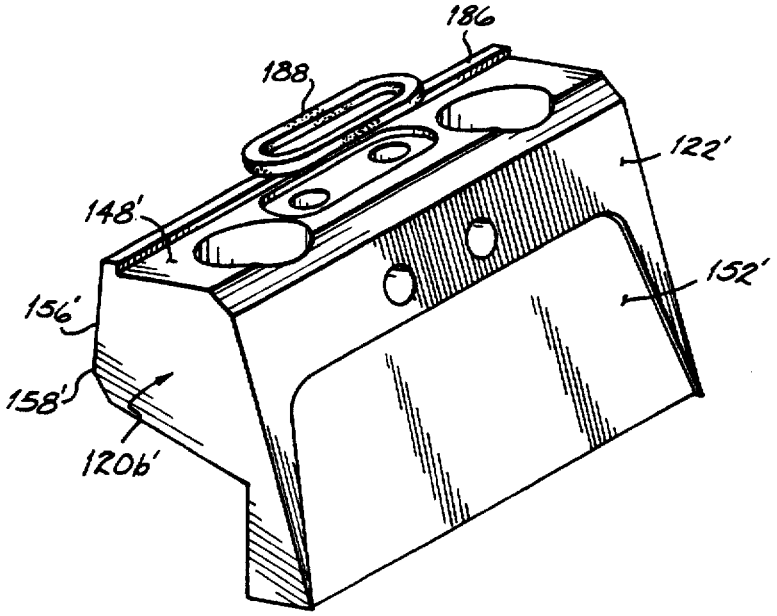
FIG. 7 is an enlarged perspective view of an alternative air block for use in the slot nozzle die of FIG. 1.
Figure 8:
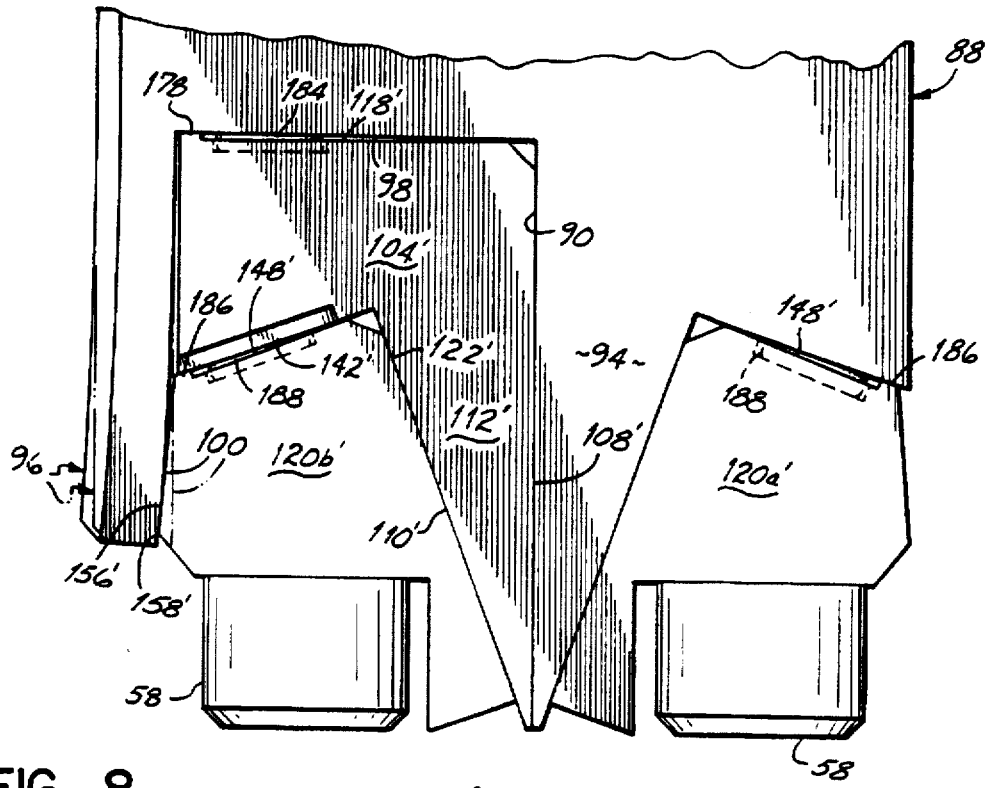
FIG. 8 an enlarged fragmentary view similar to FIG. 5 showing in greater detail the interfitting arrangement of the die components shown in FIGS. 6 and 7.

Referring now to FIGS. 6–8, an alternative and perhaps preferred embodiment of the die body 104 and air blocks 120a and 120b are shown as die body 104' and air blocks 120a' and 120b'. The die body 104' includes a substantially vertical inward surface 108' and a tapered outer surface 110' which converge at a lower end to form the tapered projection 112'. In this embodiment, the vertical inward surfaces 90 and 108' of die bodies 88 and 104', respectively, define the extrusion slot 114 which terminates in the coating material outlet or elongated slot nozzle 116 (see FIG. 1 ).

The vertical inward surface 108' of die body 104' includes a series of adhesive distribution channels 132' which receive hot melt adhesive in the same manner as and function identically to the distribution channels 132 of die body 104. In this embodiment, however, the machined inside corner 166 of die body 88 (89.5°–90°) and the machined outside corner 168 of die body 104 (90°–90.5°) are dispensed with and the respective corners are now machined nominally 90°.

To provide the pivoting action which was provided by cooperation of the seating surfaces 98 and 118 of die bodies 88 and 104, the die body 104' includes a protrusion 178 on seating surface 118' which cooperates with the seating surface 98 of die body 88 to pivot the tapered projection 112' toward the vertical inward surface 90 of die body 88. In this way, the pivoting action provided by the protrusion 178 causes hydraulic sealing of the adhesive distribution channels 132' formed between the vertical inward surfaces 90 and 108' of die bodies 88 and 104', respectively.

To prevent adhesive from moving upwardly between the die bodies 88 and 104' from the adhesive distribution channels 132', the vertical inward surface 108' of die body 104' includes a groove 180 for receiving an O-ring cord 182 which extends between opposite sides of the die body 104'. The O-ring cord 182 provides an additional fluid seal above the adhesive distribution channels 132', beyond the metal-to-metal seal provided between the die bodies 88 and 104'. To accommodate for any spacing or gap between the seating surfaces 98 and 118' of die bodies 88 and 104', the O-rings 144 of die body 104 are preferably replaced with a single gasket 184 for use with die body 104'. In all other aspects, the die bodies 104 and 104' are structurally and functionally equivalent.

Referring to FIG. 7, the alternative air block 120*b*' (preferably identical in structure to air block 120*a*' shown in FIG. 8) is shown for use in combination with the die body 104' shown in FIG. 6. The air block 120*b*' includes a tapered inner surface 122' which is adapted to be juxtaposed in operative disposition near the tapered outer surface 110' of die body 104' to form the air channel 124*b* (see FIG. 1). Preferably, the tapered inner surface 122' of air block 120*b*' includes a groove or slot 152' having a recessed surface which is parallel to surface 122'.

In this embodiment, the machined inside corner 174 of die body 104 (89.5°–90°) and the machined outside corner 176 of air block 120*b* (90°–90.5°) are dispensed with and the respective corners are now machined nominally 90°. To provide the pivoting action which was provided by cooperation of the seating surfaces 142 and 148 of die body 104 and air block 120*b*, the air block 120*b*' includes a protrusion 186 on seating surface 148' which cooperates with a seating surface 142' of die body 104' to pivot the tapered inward surface 122' of the air block toward the tapered outer surface 110' of die body 104' to improve sealing of the air channel 124*b*. To accommodate for any spacing or gap between the seating surfaces 142' and 148' of die body 104' and air block 120*b*', the O-rings 150 of air blocks 120*a* and 120*b* are preferably replaced with a single gasket 188 for use with air blocks 120*a*' and 120*b*'. In all other aspects, the air blocks 120*a*' and 120*b*' are structurally and functionally equivalent to the air blocks 120*a* and 120*b*.

As shown most clearly in FIG. 8, air block 120*b*' includes a tapered outer surface 156' which forms a protrusion 158' on the side of the air block 120*b*' opposite the tapered inward surface 122'. Preferably, air block 120*a*' also includes the tapered outer surface 156' and protrusion 158' such that the air blocks are identical and, therefore, interchangeable. During assembly of the slot nozzle die 14, the die body 104' is first slidably received in the die seat 102 in a substantially vertical direction as represented by arrow 106 in FIG. 3. Next, air block 120*b*' is slidably received in the die seat 102 in a substantially vertical direction as represented by arrow 160 in FIG. 3. As shown in FIG. 8, air block 120*b*' is disposed intermediate the tab member 96 and the tapered projection 112'.

As the air block 120*b*' is advanced vertically toward the dispenser body 12 through advancement of the screws 58 (see FIG. 8), the protrusion 158' eventually meets with the substantially vertical inward surface 100 of tab member 96 which, in turn, causes a deflection of the tab member in a substantially horizontal direction as represented by directional arrow "D" in FIG. 5. In one embodiment, the deflection of tab member 96 occurs during the last 0.030" travel of the air block 120*b*' vertically toward the dispenser body 12.

The substantially horizontal deflection of tab member 96 causes the resultant clamping force "$F_2$" (see FIG. 5) to translate the air block 120*b*' toward the tapered projection 112', which, in turn, translates toward the tapered projection 94 of die body 88 to seal the extrusion slot 114 formed between the tapered projections. Air channels 124*a* and 124*b* are likewise sealed between the air blocks 120*a*' and 120*b*', and the tapered projections 94 and 112', by the resultant clamping force "$F_2$".

Figure 9:
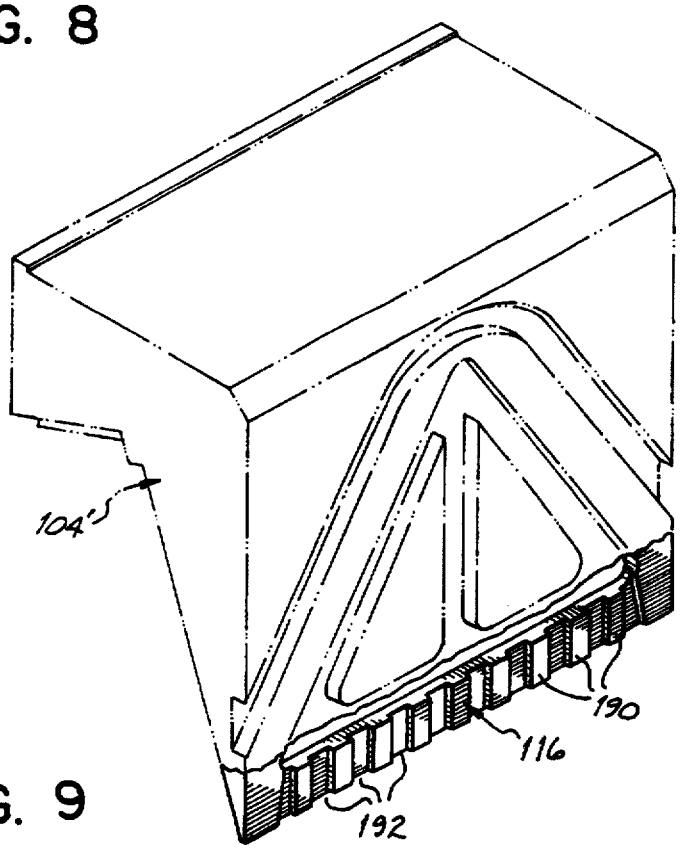
FIG. 9 is an enlarged perspective view of the die body shown in FIG. 6 including a segmented slot.

While the elongated slot nozzle 116 is shown and described with respect to FIGS. 1–5 as being a continuous open slot, an alternative slot is shown in FIG. 9 which comprises a segmented slot nozzle 116'. In this embodiment, a series of projections 190 extend within the slot and cooperate with the vertical inward surface 90 of die body 88 to form a series of outlets 192. In one embodiment as shown in FIG. 9, ten outlets 192 are formed between the tapered projections 94 and 112' of die bodies 88 and 104', with each outlet being 0.040"×0.006" for example. Those skilled in the art will appreciate that other dimensions for outlets 192 are readily available for providing a different application of coating material.

In operation of the coating dispenser 10 and the slot nozzle die 14 of the present invention, heated hot melt adhesive is introduced into the adhesive cavity 48 of the dispenser body 12 through the adhesive inlet line 70. With the ball 130 of the valve plunger 34 in engagement with the valve seat 128, adhesive is not permitted to flow from the adhesive cavity 48 to the supply passage 126 formed in the die body 88 and into the extrusion slot 114. In order to retract the valve plunger 34 and permit the flow of adhesive into the extrusion slot 114, operating air is introduced into the air cavity 32 through air inlet line 76. This pressurized air acts against a lower surface of the seal 36 connected to the valve plunger 34 which forces the plunger upwardly so that its ball 130 disengages from the seat 128 at the entrance to the supply passage 126, thereby permitting adhesive to flow into the extrusion slot 114 for application at the elongated slot nozzle 116. The valve plunger 34 is returned to its closed position by discontinuing the flow of air to the air cavity 32 allowing the return spring 42 to move the plunger back to its seated position.

The flow of hot melt adhesive entering the extrusion slot 114 is emitted from the elongated slot nozzle 116 as a continuous curtain or sheet of adhesive. At the same time the adhesive curtain is formed and ejected from the elongated slot nozzle 116, pressurized air is introduced into the air manifold 26 from the air inlet line 82. The pressurized air is directed along flow paths defined by the air passages 136*a*, 136*b*, 140 and 146 to the pair of air channels 124*a* and 124*b* disposed at an angle relative to the extrusion slot 114.

As the curtain of adhesive emerges form the elongated slot nozzle 116, the pressurized air from air channels 124*a* and 124*b* impinges upon, attenuates, and shreds the adhesive curtain to form a fibrous adhesive coating on a substrate. Intermittent control of adhesive flow through the elongated slot nozzle 116, and pressurized air flow through the air channels 124*a* and 124*b*, allows for the non-contact application of discrete, uniform fibrous coatings of adhesive having sharp, square cut-on and cut-off edges.

In another operation of the present invention, the hot melt adhesive is emitted from the elongated slot nozzle 116 as a continuous curtain or sheet of adhesive. However, the pressurized air from the air channels 124*a* and 124*b* impinges upon, but does not fiberize the curtain of adhesive. Thus, a full wide ribbon of adhesive coating may be applied to a substrate having sharp, square cut-on and cut-off edges.

Where the elongated slot nozzle 116 is segmented as shown in FIG. 9, the hot melt adhesive emits from the segmented slot nozzle as a plurality of parallel strands of adhesive. The pressurized air from the air channels 124*a* and 124*b* impinges upon, attenuates and shreds the plurality of adhesive strands to form uniform, fibrous coatings of adhesive having sharp, square cut-on and cut-off edges.

Thus, it will be appreciated that the present invention provides a slot nozzle die for use with a dispenser body which is fully interchangeable with other die structures, including adhesive curtain forming dies, bead forming dies, and controlled fiberization dies, for example. The slot nozzle die of the present invention is further fully interchangeable with slot nozzle dies of similar construction, but having different slot lengths and widths or segmented slots, in order to produce and apply varying adhesive patterns. The construction of the die bodies and air blocks provides a tight seal of the extrusion slot and air channels without the need for additional screws or fasteners, thereby permitting the slot nozzle die to be attached to a dispenser body with one a set of vertically disposed screws. The modular construction of the slot nozzle die provides for easy disassembly of the die to clean adhesive char and other contaminants from within the die.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. For example, it is contemplated that modifications to the air flow path leading to the air channels may be made without departing from the spirit and scope of the present invention. Thus, in another embodiment (not shown), the air flow path may be changed from an "outside-in" direction to an "inside-out" direction, thereby eliminating the need for air passages 146 in the air blocks 120*a* and 120*b*. Equivalent structures will be appreciated by those skilled in the art for providing the self-sealing pneumatic and hydraulic seals of the present invention. The invention in its broader aspects is therefore not limited to the specific details, representative apparatus and method, and illustrative example shown and described. Accordingly, departures may be made from such details without departing from the spirit or scope of applicant's general inventive concept.

Having described the invention, what is claimed is:

1. A self-sealing die for use with a coating dispenser which includes a coating material supply passage and a plunger movable within the supply passage, comprising:

a first die body having a first tapered projection defined by a substantially vertical inward surface and a tapered outer wall, said first die body further having a die seat disposed adjacent said substantially vertical inward surface;

a second die body having a second tapered projection defined by a substantially vertical inward surface and a tapered outer wall, said second die body being adapted to be slidably received in said die seat thereby to define a coating material outlet between said substantially vertical inward surfaces of said first and second tapered projections, said tapered outer walls respectively partially defining inward surfaces of two air channels disposed at an angle with respect to said coating material outlet; and two air blocks, each having a tapered inward surface juxtaposed in operative disposition near one of said tapered outer walls of said first and second tapered projections to form one of said air channels therebetween, one of said air blocks being slidably received in said die seat and further being operable to cooperate with said die seat for translating said second tapered projection toward said first tapered projection to seal said first and second die bodies.

2. The self-sealing die of claim 1 wherein said first die body includes a tab member depending therefrom and horizontally spaced from said first tapered projection to define said die seat therebetween.

3. The self-sealing die of claim 2 wherein said tab member is operable to deflect toward said first tapered projection for translating said second tapered projection toward said first tapered projection to seal said first and second die bodies.

4. The self-sealing die of claim 1 wherein said coating material outlet comprises a continuous open slot.

5. The self-sealing die of claim 1 wherein said coating material outlet comprises a segmented slot.

6. A self-sealing die for use with a coating dispenser which includes a coating material supply passage and a plunger movable within the supply passage, comprising:

a first die body having a first tapered projection defined by a substantially vertical inward surface and a tapered outer wall, said first die body further having a tab member depending therefrom and horizontally spaced from said first tapered projection to define a die seat therebetween;

a second die body having a second tapered projection defined by a substantially vertical inward surface and a tapered outer wall, said second die body being adapted to be slidably received in said die seat thereby to define a coating material outlet between said substantially vertical inward surfaces of said first and second tapered projections, said tapered outer walls respectively partially defining inward surfaces of two air channels disposed at an angle with respect to said coating material outlet; and two air blocks, each having a tapered inward surface juxtaposed in operative disposition near one of said tapered outer walls of said first and second tapered projections to form one of said air channels therebetween, one of said air blocks being slidably received intermediate said tab member and said second tapered projection and further being operable to cooperate with said tab member for translating said second tapered projection toward said first tapered projection to seal said first and second die bodies.

7. The self-sealing die of claim 6 wherein said first die body includes a passage in fluid communication with said coating material supply passage and said coating material outlet for delivering coating material from said supply passage to said outlet.

8. The self-sealing die of claim 6 wherein said first die body includes at least two air passages therethrough in fluid communication with at least one selectively operable air source.

9. The self-sealing die of claim 8 wherein said second die body includes at least one air passage therethrough in fluid communication with one of said air passages of said first die body.

10. The self-sealing die of claim 9 wherein each of said air blocks includes at least one air passage therethrough, one of said air passages of one of said air blocks being in fluid communication with one of said air passages of said first die body and one of said air channels, said other air passage of said other air block being in fluid communication with said air passage of said second die body and said other air channel whereby said air source is selectively operable to deliver air to said two air channels.

11. The self-sealing die of claim 1 wherein said tab member is operable to deflect toward said first tapered projection for translating said second tapered projection toward said first tapered projection to seal said first and second die bodies.

12. The self-sealing die of claim 7 wherein said substantially vertical inward surface of said second die body includes a plurality of coating distribution channels in fluid communication with said passage for distributing said coating material within said coating material outlet.

13. The self-sealing die of claim 6 wherein said coating material outlet comprises a continuous open slot.

14. The self-sealing die of claim 6 wherein said coating material outlet comprises a segmented slot.

15. A self-sealing die for use with a coating dispenser which includes a coating material supply passage and a plunger movable within the supply passage, comprising:

a first die body having a first tapered projection defined by a substantially vertical inward surface and a tapered outer wall, said first die body further having a deflectable tab member depending therefrom and horizontally spaced from said first tapered projection to define a die seat therebetween;

a second die body having a second tapered projection defined by a substantially vertical inward surface and a tapered outer wall, said second die body being adapted to be slidably received in said die seat thereby to define a coating material outlet between said substantially vertical inward surfaces of said first and second tapered projections, said tapered outer walls respectively partially defining inward surfaces of two air channels disposed at an angle with respect to said coating material outlet; and two air blocks, each having a tapered inward surface juxtaposed in operative disposition near one of said tapered outer walls of said first and second tapered projections to form one of said air channels therebetween, one of said air blocks being slidably received intermediate said deflectable tab member and said second tapered projection and further having a tapered outer surface which cooperates with a substantially vertical inward surface of said deflectable tab member for translating said second tapered projection toward said first tapered projection to seal said first and second die bodies.

16. The self-sealing die of claim 16 wherein said coating material outlet comprises a continuous open slot.

17. The self-sealing die of claim 16 wherein said coating material outlet comprises a segmented slot.

18. A self-sealing die for use with a coating dispenser which includes a coating material supply passage and a plunger movable within the supply passage, comprising:

a first die body having a first tapered projection and a deflectable tab member depending therefrom, said first tapered projection and said deflectable tab member being horizontally spaced thereby to define a die seat therebetween;

a second die body having a second tapered projection depending therefrom, said second die body being adapted to be slidably received in said die seat in a substantially vertical direction thereby to define a coating material outlet between inward surfaces of said first and second tapered projections, said first and second tapered projections further including outer surfaces which partially define two air channels disposed at an angle with respect to said coating material outlet; and two air blocks, each having a tapered inward surface juxtaposed in operative disposition near one of said outer surfaces of said first and second tapered projections to form one of said air channels therebetween, one of said air blocks being slidably received intermediate said deflectable tab member and second tapered projection in a substantially vertical direction, said deflectable tab member being operable to deflect in a substantially horizontal direction responsive to movement of said one air block in said vertical direction for translating said second tapered projection toward said first tapered projection to seal said first and second die bodies.

19. The self-sealing die of claim 18 wherein said coating material outlet comprises a continuous open slot.

20. The self-sealing die of claim 18 wherein said coating material outlet comprises a segmented slot.

* * * * *

UNITED STATES PATENT AND TRADEMARK OFFICE

CERTIFICATE OF CORRECTION

PATENT NO. : 5,740,963

DATED : April 21, 1998

INVENTOR(S) : Riney et al.

It is certified that error appears in the above-identified patent and that said Letters Patent is hereby corrected as shown below:

Column 2, line 26, please delete "extending in more than plane" and replace with --extending in more than one plane--.

Column 4, line 37, please delete "Fig. 8 an enlarged" and replace with --Fig. 8 is an enlarged--.

Column 11, line 6, please delete "adhesive emerges form" and replace with --adhesive emerges from--.

Column 11, line 41, please delete "with one a set" and replace with --with a set--.

Column 14, line 16, please delete "die of claim 16" and replace with --die of claim 15--.

Column 14, line 18, please delete "die of claim 16" and replace with --die of claim 15--.

Signed and Sealed this

Tenth Day of November 1998

*Attest:*

*Attesting Officer*

BRUCE LEHMAN

*Commissioner of Patents and Trademarks*